United States Patent [19]

Shimada et al.

[11] 4,218,528

[45] Aug. 19, 1980

[54] ELECTROPHOTOGRAPHIC PHOTORECEPTOR WITH PHTHALOCYANINE IN PHENOL RESIN BINDER

[75] Inventors: Fumio Shimada, Fussa; Masatoshi Matsuzaki, Nino; Masafumi Uehara, Koganei, all of Japan

[73] Assignee: Konishiroku Photo Industry Co., Ltd., Tokyo, Japan

[21] Appl. No.: 913,668

[22] Filed: Jun. 8, 1978

[30] Foreign Application Priority Data

Jun. 27, 1977 [JP] Japan ..... 52-76359
Feb. 7, 1978 [JP] Japan ..... 53-12685

[51] Int. Cl.[2] ..... G03G 5/06
[52] U.S. Cl. ..... 430/76; 430/96
[58] Field of Search ..... 96/1.5 R

[56] References Cited

U.S. PATENT DOCUMENTS

| | | | |
|---|---|---|---|
| 3,408,181 | 10/1968 | Mammino | 96/1.5 R X |
| 3,672,979 | 6/1972 | Gerace et al. | 96/1.5 R X |
| 3,709,684 | 1/1973 | Feltzin et al. | 96/1.5 R |
| 3,816,118 | 6/1974 | Byrne | 96/1.5 R |
| 4,106,935 | 8/1978 | Petruzzella | 96/1.5 R |

*Primary Examiner*—Ronald E. Martin, Jr.
*Attorney, Agent, or Firm*—Robert E. Burns; Emmanuel J. Lobato; Bruce L. Adams

[57] ABSTRACT

The method for forming an electrostatic image according to the present invention comprises the steps of charging an electrophotographic photoreceptor, which is subjected to dark decay after the charging step, and effecting an exposure by activation light and an imagewise exposure on the electrophotographic photoreceptor. The exposure by activation light is effected prior to the imagewise exposure and in a step including at least a portion of the charging step or dark decay. This causes a remarkable sensitization effect in the electrophotographic photoreceptor, suitably adapted for use in an electrophotographic copying machine of a repeated transfer type.

4 Claims, 10 Drawing Figures

FIG. I
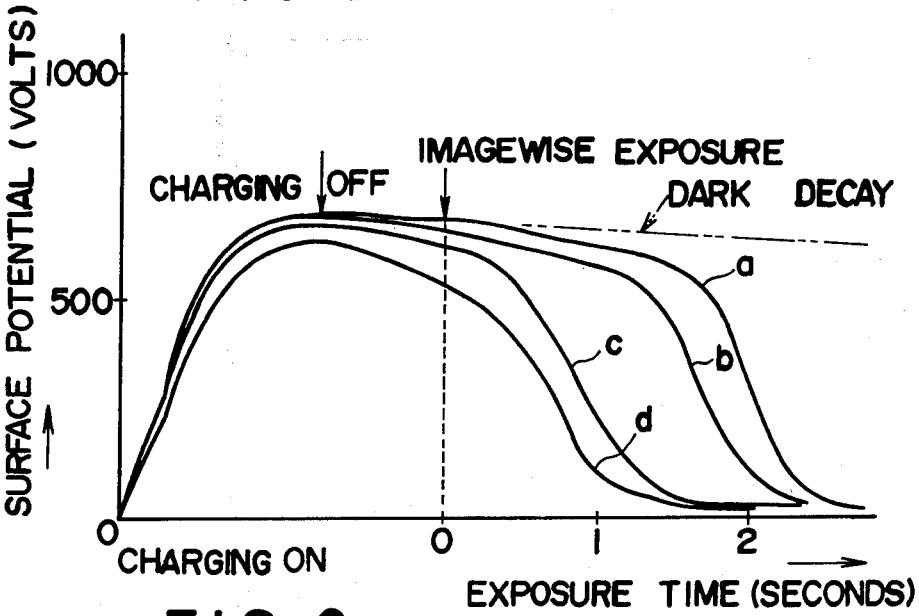
FIG. 2
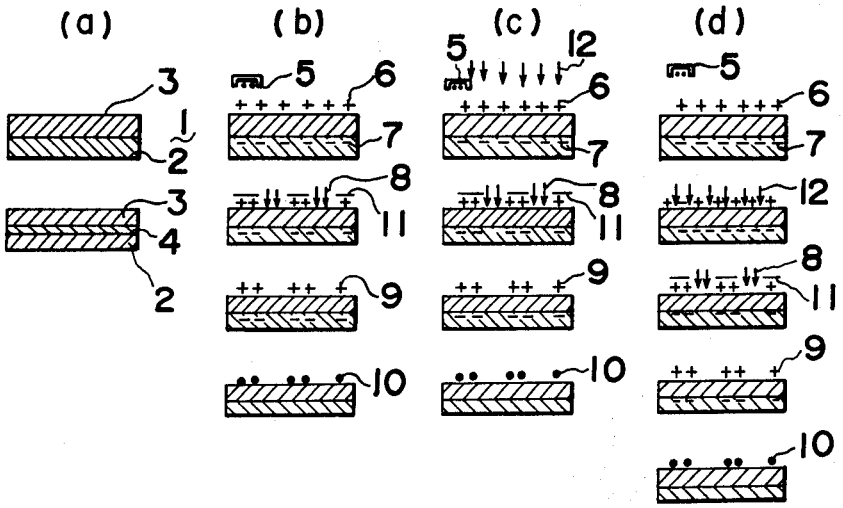

ELECTROPHOTOGRAPHIC PHOTORECEPTOR WITH PHTHALOCYANINE IN PHENOL RESIN BINDER

BACKGROUND OF THE INVENTION

The present invention relates to a method for forming an electrostatic image in which an exposure by activation light is effected prior to an imagewise exposure on an electrophotographic photoreceptor comprising a conductive support and an photosensitive layer supported thereon which includes a resin and fine photoconductive powder dispersed therein, and further relates to an electrophotographic photoreceptor suitably adapted for use in this method.

In an electrophotography in the prior art, an electrophotographic photoreceptor is provided with photosensitivity by charging by means of known methods, and then directly formed thereon with an electrostatic image by effecting an imagewise exposure. Alternatively, the electrostatic image is electrostatically transferred on a sheet of transfer paper, then developed by means of a dry or wet developer and fixed to produce a visible image. In the recent electrophotography, on the other hand, the electrostatic image formed on the electrophotographic photoreceptor is developed by a developer to produce a powdered image, which is electrostatically transferred on a sheet of transfer paper and then fixed to form the visible image.

To produce the visible image with the aid of such electrophotography, it is first of all necessary to form an electrostatic image which has excellent characteristics with respect to charging, dark decay and light decay.

Further, an electrophotographic photoreceptor, particularly for use in an electrophotographic copying machine of the repeated transfer type, is required to have characteristics in which it is free from wear or degradation without any reduction in quality of the image, even after the repetitive use thereof for a great number of copies.

The photoconductive material preferably used in electrophotography is, for example, an inorganic photoconductive material such as selenium, zinc oxide, zinc sulphide, cadmium sulphide, cadmium selenide, cadmium sulphide selenide, mercury sulphide, titanium oxide or lead oxide; a photoconductive pigment such as metalfree phthalocyanine, copper phthalocyanine, cobalt phthalocyanine, nickel phthalocyanine, zinc phthalocyanine or lead phthalocyanine; or an organic photoconductive material such as poly-N-vinylcarbazole, anthracene or triallylamine derivatives. An inorganic photoconductive powder and an photoconductive pigment are particularly suitable for an electrophotographic photoreceptor containing a binder resin and a powdered photoconductive material, i.e., photoconductive powder dispersed therein. The photoconductive powder usually used in electrophotography is more than 0.3 micron in average granularity, and thus relatively large. A photoreceptor is further preferably used which contains an amount of resin relative to the photoconductive powder which is as small as possible in order to provide an efficient photoconductivity in the photoconductive powder. In other words, the electrophotographic photoreceptor contains a small amount of resin and relatively large-granulated photoconductive powder dispersed therein, because a photoreceptor with a rapid light decay is required, in view of the fact that high-speed reproduction capable of reproducing a great number of copies in a short time is commercially demanded, because of a tendency to prefer reproduction by means of an electrophotographic copying machine of the repeated transfer type. Such an electrophotographic photoreceptor indeed has a rapid light decay, but poor characteristics with respect to charging, dark decay, image quality and wear resistance.

On the other hand, many efforts have been made to use an electrophotographic photoreceptor containing small-granulated photoconductive powder. Such a photoreceptor has excellent characteristics with respect to charging, dark decay, image quality and wear resistance, but is disadvantageously very poor with respect to light decay. To overcome the drawbacks, proposals have been made in which photoconductive powder having the large granularity is suitably mixed with photoconductive powder having a small granularity, or a photosensitive layer dispersively containing photoconductive powder of large granularity is combined in overlaid relationship with a photosensitive layer dispersively containing photoconductive powder of the small granularity, thereby providing a laminated electrophotographic photoreceptor. These proposals, however, do not produce a superimposed effect of excellent properties, but only average properties. A protective layer is further often provided to protect the surface of the electrophotographic photoreceptor, because it suffers from an electric impact or mechanical wear, in view of the fact that little resin is contained therein. This, on the contrary, causes the degradation of the light decay property and an increase in residual charges, with the result that a practically preferable electrophotographic photoreceptor is not achieved.

In published examined Japanese patent applications Sho 42-5912 and Sho 51-39538 or published unexamined Japanese patent application Sho 48-54946 for example, there is, disclosed a method in which an overall exposure is performed on the electrophotographic photoreceptor prior to the charging and imagewise exposure steps to improve the wear resistance, i.e., one of the properties, of the electrophotographic photoreceptor used in an electrophotographic copying machine of the repeated transfer type. However, such a method is intended to weaken the reduction in charge potential and the increase in dark decay caused by the repetition of the charging and exposure in the electrophotographic photoreceptor, and not to provide a positive improvement in properties of the light decay and image quality.

Further a method is known involving the overall irradiation on the residual toner image, by means of a cleaning lamp for easy cleaning, prior to the removal of the toner by means of a cleaning brush and a method of making an overall exposure, prior to the charging step to restore a memory in the electrophotographic photoreceptor. This method is particularly adapted for use in an electrophotographic copying machine of the repeated transfer type in which the electrophotographic photoreceptor is subjected to the charging and exposure steps to prepare an electrostatic image, which is developed by the developer to produce a toner image transferred on a paper with these steps repeated to reproduce a great number of images. This method is also primarily intended to clean the toner image, and not to improve various characteristics, particularly with respect to the light decay in the electrophotographic photoreceptor.

SUMMARY OF THE INVENTION

It is therefore a primary object to this invention to provide a method for forming an electrostatic image free from the above-mentioned drawbacks.

It is another object of this invention to provide a method for forming an electrostatic image, which has excellent properties of charging, dark decay and light decay and is capable of producing a visible image of high quality.

It is still another object of this invention to provide a method for forming an electrostatic image and a photoreceptor, suitably adapted for use in an electrophotographic copying machine of the repeated transfer type, because of its excellence in charging property, mechanical wear resistance and electric impact resistance.

It is yet another object of this invention to provide a method for forming an electrostatic image, suitable for high-speed reproduction, because of a remarkable increase in sensitivity due to exposure by activation light.

It is a further object of this invention to provide a method for forming an electrostatic image, in which an exposure by activation light having wavelength regions of high sensitivity in an electrophotographic photoreceptor is made for sensitization in wavelength regions of low sensitivity in the photoreceptor.

It is a still further object of this invention to provide a method for forming an electrostatic image, which is capable of providing a high-sensitive electrophotographic photoreceptor useful for reproduction due to an exposure by activation light.

It is a further object of this invention to provide a method for forming an electrostatic image, which is capable of producing a high-contrast electrostatic image and toner image due to an exposure by activation light.

It is a still further object of this invention to provide a method for forming an electrostatic image, adapted for use in high-speed reproduction using a laser beam.

It is a still further object of this invention to provide an electrophotographic photoreceptor adapted for use in a method for forming an electrostatic image of the present invention, which has excellent charging properties, mechanical wear resistance and electric impact resistance.

It is a still further object of this invention to provide a method for forming an electrostatic image, which use a photosensitive layer preferably consisting of a phenol resin and a photoconductive phthalocyanine pigment.

According to the present invention, a method for forming an electrostatic image comprises the steps of charging an electrophotographic photoreceptor which comprises a photosensitive layer of a resin and fine photoconductive powder dispersed in the resin and a conductive support for the photosensitive layer, the photoreceptor being subjected to dark decay after the charging step, effecting an exposure by activation light on the electrophotographic photoreceptor, and effecting an imagewise exposure on the electrophotographic photoreceptor. The exposure by activation light is effected prior to the imagewise exposure and in a step including at least a portion of the charging step or dark decay.

The activation light, originating from a halogen lamp, fluorescent lamp, tungsten lamp, mercury lamp or xenon lamp, has a spectrum over a range including at least a portion of an absorption wavelength range in the photoconductive powder. The activation light exposure, which may be effected by the use of an electrostatic image cleaning lamp, is preferably 0.1 to 10 times as great in quantity of light as the imagewise exposure.

The resin most suitably used in this method is a phenol resin consisting essentially of a substance having the following general formula

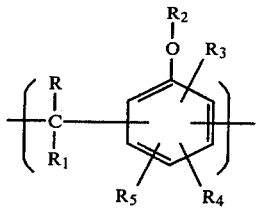

where R and $R_1$ are a hydrogen atom or methyl radical, $R_2$ a hydrogen atom or epoxy radical and $R_3$, $R_4$, $R_5$, a hydrogen atom, halogen atom or alkyl or alkoxy radical having 1 to 20 carbon atoms, at least one of $R_3$, $R_4$, and $R_5$ being an alkyl or alkoxy radical having 4 to 20 carbon atoms.

The fine photoconductive powder must suitably used in combination with the phenol resin in the electrophotographic photoreceptor is a photoconductive phthalocyanine pigment such as metalfree phthalocyanine, copper phthalocyanine, cobalt phthalocyanine, lead phthalocyanine or zinc phthalocyanine, which is preferably 0.01 to 0.3 micron in averaged granularity. The photoconductive powder of phthalocyanine pigments is blended with the resin in a ratio of 1:3 to 1:20 by weight.

Thus, in the method according to the present invention, the electrophotographic photoreceptor is subjected to activation light exposure for activation and sensitization prior to the imagewise exposure and in a step including at least a portion of the charging step or dark decay. This allows rapid light decay and thus high-speed reproduction of images in an electrophotographic copying machine of the repeated transfer type. Further, the use of an electrophotographic photoreceptor, for example, containing a photoconductive phthalocyanine pigment and a phenol resin allows the high-speed reproduction of images and the preparation of a lithographic plate by means of a laser beam.

The activation and sensitization of the electrophotographic photoreceptor according to this method makes it possible to use fine photoconductive powder, which is preferably 0.01 to 0.3 micron in average granularity. This allows the formation of an electrostatic image in electrophotography, which has excellent properties with respect to charging and light decay. The electrostatic image is developed by a developer to form a visible image, which is very fine and has a high resolution because of the use of fine photoconductive powder.

The use of the fine photoconductive powder, on the other hand, allows the use of much resin with the result that an electrophotographic photoreceptor is obtained which has an excellent charging property, mechanical wear resistance and electric impact resistance, and thus has a great resistance against electrical impact such as corona discharge in an electrophotographic copying machine of the repeated transfer type.

Thus, it will be understood that the method according to the present invention is quite superior to the methods in the prior art, for example, a method for use in the known electrophotographic copying machine of the repeated transfer type, in which an overall exposure is effected by a cleaning lamp prior to the charging step to clean a residual toner image or restore the memory of the photoreceptor.

In the electrophotographic photoreceptor containing fine photoconductive powder preferably 0.01 to 0.3 micron in average granularity or relatively much resin, the photoconductive powder is coated with the resin to a great extent. In this case, however light decay is prevented by resin between the photoconductive particles with the result of low sensitivity. The previous exposure to activation light, however, causes acceleration of the light decay with the result of high sensitivity. The reason for this result is not apparent, but it is theorized that carriers are produced depending on the number of photons and sufficiently captured in the trap (in this case, in the resin between the photoconductive particles) within the photoconductive layer, and the imagewise exposure cause the contribution of the carriers to the efficient light decay without any capture in the trap or causes the release of the carriers already captured by the imagewise exposure with the superimposing effect on the light decay.

Other objects and advantages will be apparent when reading the following detailed description made by way of examples in conjunction with the accompanying drawings in which:

Brief Description of the Drawings

FIG. 1 is a graph showing electrostatic characteristics of an electrophotographic photoreceptor in an example 1 of the invention, in which an exposure by activation light is effected thereon at various times;

FIGS. 2*a* to 2*d* are sectional views showing the construction of an electrophotographic photoreceptor according to the invention and steps along which a visible image is formed;

DETAILED DESCRIPTION OF THE PREFERRED EMBODIMENTS

Figure 3:
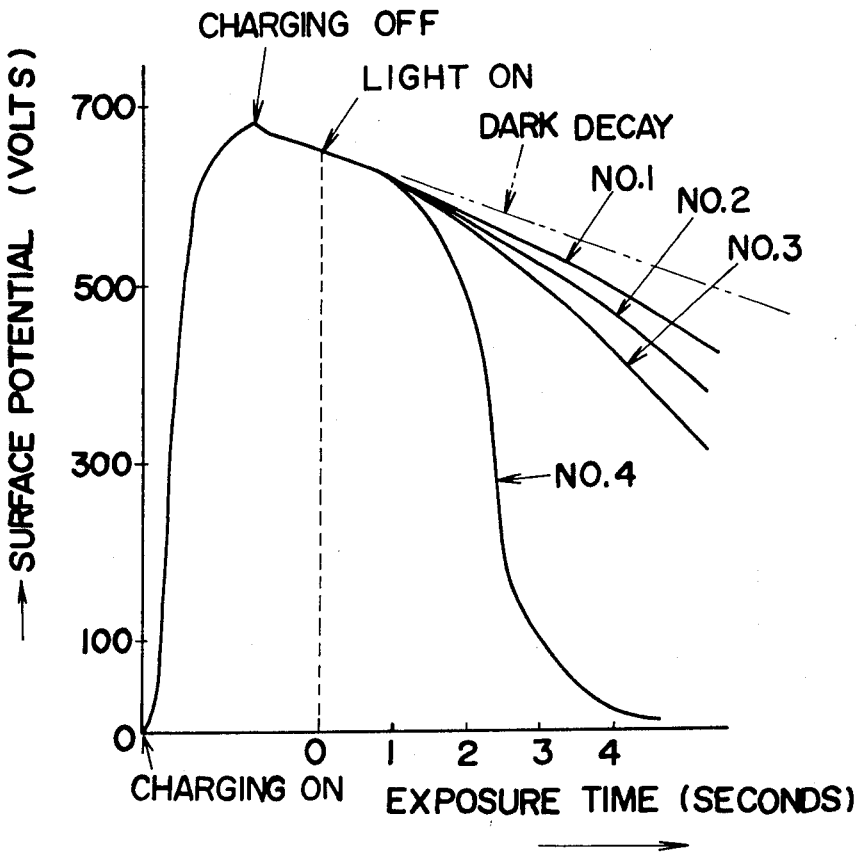
FIG. 3 is a graph showing electrostatic characteristics in an example 5 of the invention in which an imagewise exposure is effected by the use of light having a single wavelength of 480 millimicrons.

The fine photoconductive powder used in the present invention made, for example of a photoconductive phthalocyanine pigment disclosed in published examined Japanese patent specifications Sho 48-34189, 49-4338, 49-17535 and published unexamined Japanese patent specifications Sho 47-30328, 47-30329, 50-38543, 51-23738; photoconductive zinc oxide prepared by a French method involving evaporating metallic zinc for oxidization in an atmosphere of air; or a photoconductive material such as cadmium sulphide, cadmium selenide, cadmium sulphide selenide, zinc sulphide prepared according to a method disclosed in U.S. Pat. No. 3,743,609 and published unexamined Japanese patent specification Sho 51-53493.

The phthalocyanine pigment used in the present invention is indicated by the formula $(C_8H_4N_2)_4Rn$, where R is an hydrogen atom, deuterium, lithium, sodium, potassium, copper, silver, beryllium, magnesium, calcium, zinc, cadmium, barium, mercury, aluminum, gallium, indium, lanthanum, neodymium, samarium, europium, gadolinium, dysprosium, holmium, erbium, thulium, ytterbium, lutetium, titanium, tin, hafnium, lead, thorium, vanadium, antimony, chromium, molybdenum, uranium, manganese, iron, cobalt, nickel, rhodium, palladium, osmium or platinum, and n is 0 to 2.

It is preferable to select $\alpha$, $\beta$, $\gamma$, $\pi$, $\chi$or $\epsilon$-type (crystalline form) metalfree phthalocyanine or metallic phthalocyanine such as copper, cobalt, lead or zinc phthalocyanine, which is preferably 0.01 to 0.3 micron in average granularity. The fine photoconductive powder of zinc oxide, titanium oxide, lead oxide or cadmium sulphide is also preferably 0.01 to 0.3 micron in average granularity. A large granularity is not suitable for the present invention because the powder is liable to wear or degradation upon exposure to light and/or corona discharge. A smaller granularity, on the other hand, is also not suitable because of degraded photoconductivity.

The resin (serving as a binder) used in an electrophotographic photoreceptor according to the present invention is, for example, an electrically insulating resin such as styrene resin, acrylic resin, vinyl chloride-vinyl acetate copolymer, vinyl acetate-methyl methacrylate copolymer, styrene-butadiene copolymer, vinyl toluene-butadiene copolymer, polycarbonate resin, polyurethane resin, phenol resin, melamine resin, furan resin, polyester resin or expoxy resin.

Among the above-mentioned materials, the photoconductive phthalocyanine pigment and phenol resin are preferably used in the method for forming an electrostatic image according to the present invention. The most preferably used phenol resin consists essentially of a substance having the following formula

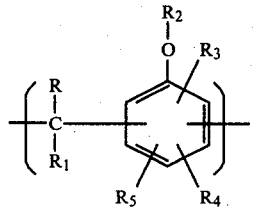

where R, $R_1$ are a hydrogen atom or methyl radical, $R_2$ a hydrogen atom or epoxy radical, and $R_3$, $R_4$, $R_5$ a hydrogen atom, halogen atom or alkyl or alkoxy radical having 1 to 20 carbon atoms, at least one of $R_3$, $R_4$, $R_5$ being an alkyl or alkoxy radical having 4 to 20 carbon atoms.

Particular examples of the phenol resin indicated by the above formula are as follows:

(1)

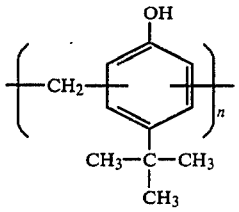

n ≈ 10

(2)

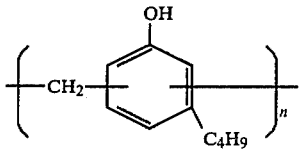

n ≈ 10

(3)

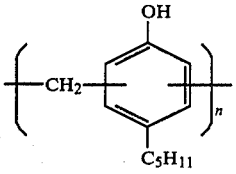

n ≈ 15

(4)

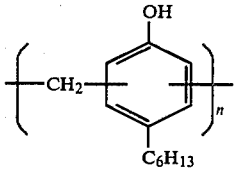

n ≈ 15

(5)

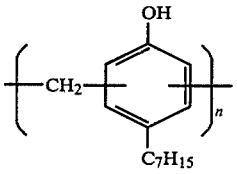

n ≈ 15

(6)

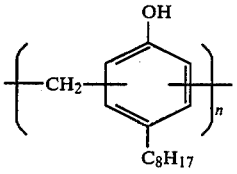

n ≈ 15

(7)

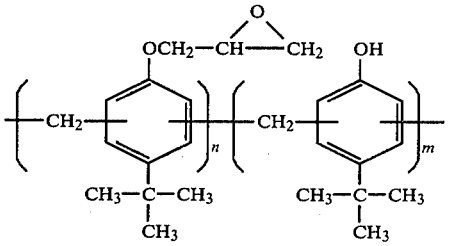

n ≈ 5 m ≈ 5

(8)

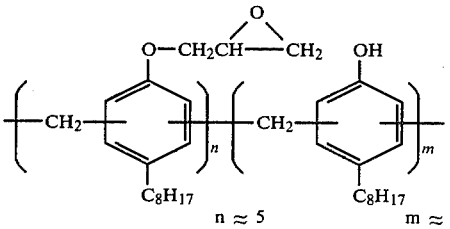

n ≈ 5 m ≈ 10

-continued (9)

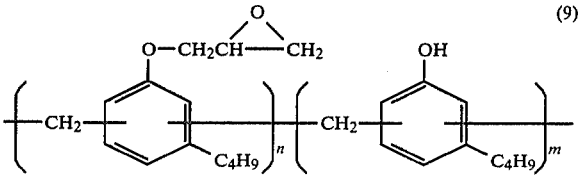

n ≈ 5 m ≈ 10

(10)

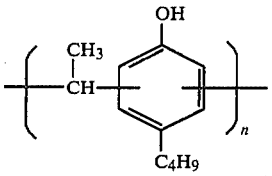

n ≈ 20

(11)

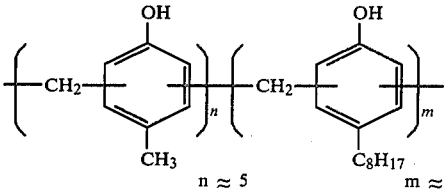

n ≈ 5 m ≈ 15

(12)

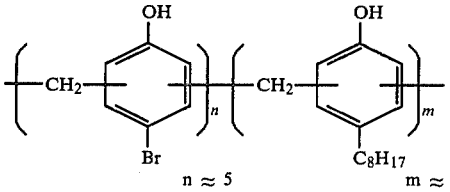

n ≈ 5 m ≈ 15

(13)

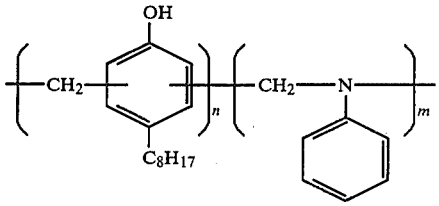

n ≈ 15 m ≈ 5

(14)

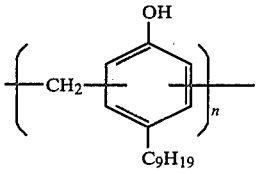

n ≈ 40

(15)

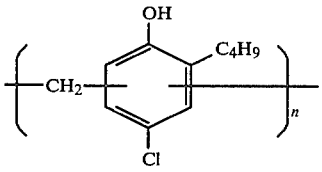

n ≈ 18

(16)

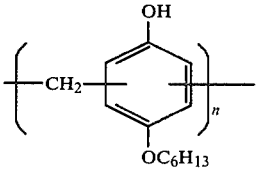

n ≈ 25

-continued (17)

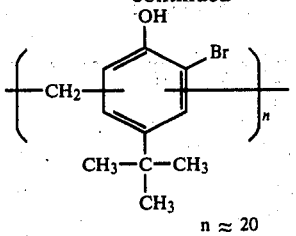

n ≈ 20

(18)

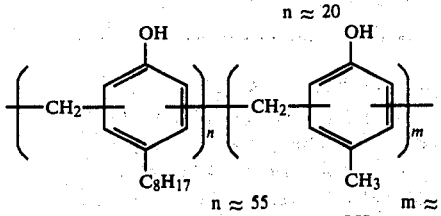

n ≈ 55 m ≈ 5

(19)

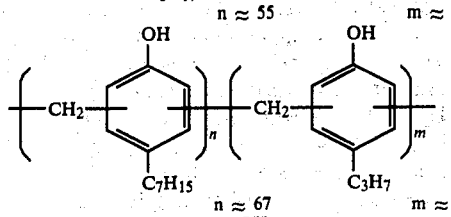

n ≈ 67 m ≈ 3

(20)

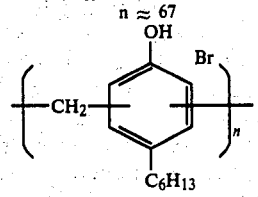

n ≈ 50

(21)

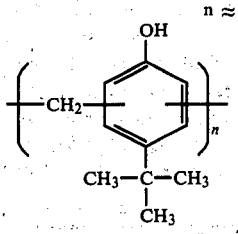

n ≈ 75

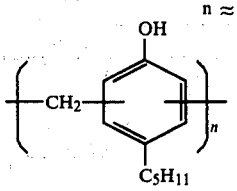

n ≈ 80

(22

(23)

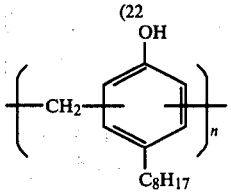

n ≈ 3

(24)

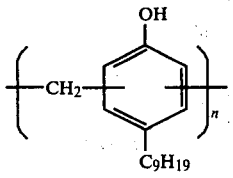

n ≈ 5

In the chemical formulas, m and n means the polymerization degree, and the polymerization degree of these resins amounts to 2 to 10,000, preferably, 2 to 100.

Other examples of the phenol resin shown by the previous formula is a resin of melamine, lignin, cumarone, aniline, indene, hydrocarbon, polyvinyl alcohol, fatty acid amide having 12 to 20 carbon atoms, acetate, lactone, acetal, chlorophenol, thiophene or styrenated phenol, or also substances modified by these monomers.

The phenol resin of the above formula may be used in a mixture with another resin compatible therewith such as acrylic resin, epoxy resin, styrene maleic anhydride copolymer, polyvinyl acetate, vinylidene chloride-acrylonitrile copolymer, or in a mixture with phenol resins not covered by the present invention.

The resin of the present invention having a phenol molecular unit preferably includes at least one substituted radical of 4 to 20 carbon atoms. A phenol resin having less than three carbon atoms results in reduced sensitivity of the electrophotographic photoreceptor and poor sensitization effect due to the activation light exposure. A phenol resin having more than twenty one carbon atoms, on the other hand, has remarkably reduced solubility in a solvent with the result that the photoreceptor does not form.

In the preparation of an electrophotographic photoreceptor 1 according to the present invention as shown in FIG. 2*a*, a photosensitive solution is first prepared by preparing a mixture of 100 parts of photoconductive powder, 15 to 2000 parts of a resin and, if necessary, 0.05 to 10 parts of a sensitizing dye and dispersively mixing the mixture with 50 to 10,000 parts of an organic solvent. The sensitizing dye is, for example, a material such as rose bengal, auramine, bromophenol blue, bromothymol blue, fuchsine or the like, or 2,4,7-trinitro-9-fluorene, or 2,4,5,7-tetranitro-fluorene. The organic solvent is a liquid such as benzene, toluene, xylene, trichloroethylene, ethyl-acetate, acetone, methyl-ethyl-keton or the like. The photosensitive solution is then applied on a conductive support 2 such as a metallic plate of copper, iron, nickel, aluminum or stainless steel; a support prepared by evaporating or laminating on paper or plastic film a metal such as aluminum, gold, silver, copper or nickel, or metallic oxide such as tin oxide; or a support coated with a layer comprising a resin and powder dispersed in the resin such as powder of the above metal or metallic oxide or powder of carbon black. The photosensitive solution is applied so as to be 1 to 50 microns thick after it has been dried. Thus, a photosensitive layer 3 is prepared. Between the photosensitive layer 3 and the support 2 there is provided, if necessary, an intermediate layer 4 made of a high molecular organic compound or semiconductor layer having a rectifying characteristic.

The ratio of the photoconductive powder to resin in the photosensitive layer is preferably 6:1 to 1:2 by weight for the inorganic photoconductive powder. The increase of the photoconductive powder above this ratio results in degraded wear resistance and electrical impact resistance as well as poor sensitization effect due to the activation light exposure. An increase of a resin leads to the remarkable degradation of photosensitivity with the result of no practicability. For photoconductive phthalocyanine, the ratio is preferably 1:3 to 1:20 by weight. An increase of photoconductive phthalocyanine disadvantageously causes degradation of charging characteristic, with the result of the difficult charging and increase in dark decay. An increase of the resin, on the other hand, causes a remarkable degradation of the photosensitivity; thus the photosensitive layer is not practical.

In the method according to the present invention, the electrophotographic photoreceptor 1 is irradiated all over the surface with activation light 12 prior to an imagewise exposure as shown in FIG. 2, i.e., simultaneously with the corona discharge 6, 7 as shown in FIG. 2*c*, or at a time during an interval between the corona discharge 6, 7 and the imagewise exposure 8 as shown in FIG. 2*d*, thereby forming an electrostatic image 9. In other words, the activation light 12 is radiated on the overall surface of the electrophotographic photoreceptor 1 prior to the imagewise exposure 8 and in a step including at least a portion of the charging step or dark decay to activate the fine photoconductive powder. The imagewise exposure is then effected through a pattern 11 prior to the disappearance of the activation of the powder to accelerate the light decay, thereby rapidly forming the electrostatic image 9, with the result of rapid formation of a visible iamge 10.

The light source is that usually used for an imagewise exposure such as a halogen lamp, tungsten lamp, xenon lamp, fluorescent lamp, mercury lamp or incandescent lamp. A halogen lamp or tungsten lamp is used preferably. Further a laser beam source can be used particularly efficiently.

A light source for the activation light of the invention is substantially the same as that for the imagewise exposure. The fluorescent lamp used as a cleaning lamp in the electrophotographic copying machine of the repeated transfer type may be effectively used addition to the halogen or tungsten lamp. Where a laser beam is used to effect the imagewise exposure, another laser beam can be used to generate the activation light. The quantity of light in the imagewise exposure usually amounts to 2 lux-seconds for a photoreceptor or selenium, 5 to 20 lux-seconds for a photoreceptor of zinc oxide, 3 to 20 lux-seconds for a photoreceptor of cadmium sulphide and 5 to 40 lux-seconds for a photoreceptor of phthalocyanine. The quantity of activation light is, on the other hand, 0.01 to 100, preferably 0.1 to 10 times as great as the quantity of exposure light for each photoreceptor. The activation light has a spectrum substantially the same as that of the light for the imagewise exposure, or a narrow spectrum corresponding to a strong absorption wavelength region in the photoreceptor. For this purpose, a tungsten lamp of 2854° K. is used, for example, in combination with an interference filter KL 45, 50, 55, 60, 65, 70 or 80 manufactured by Toshiba Kasei Industrial co., Ltd., and further in combination with colored glass to derive therefrom a narrow spectrum of wavelength corresponding to the absorption spectrum in the photorecptor, thereby generating activation light.

The activation light is radiated prior to the imagewise exposure as mentioned above, and preferably in a step including the charging step during which the activation light effectively acts upon the photoreceptor.

The cleaning lamp usually provided in the electrophotographic copying machine may be used as a light source for the activation exposure through light guide means such as an optical fiber or lens system. This allows the cleaning of residual toners, and the prevention of potential decay and increase of fog, and further causes the acceleration of the light decay, with the copying machine thus improved in capability, construction and costs.

The examples of the present invention will now be described. It is, however, apparent that the present invention is not limited to these examples.

EXAMPLE 1

| | |
|---|---|
| ε-type copper phthalocyanine pigment, Lionol Blue ER (manufactured by Toyo Ink Co. Ltd.) | |
| Desmorhen 800 (polyester polyol manufactured by Japan | 1 part by weight |
| Polyurethane Co. Ltd. | 2 parts by weight |
| hexamethylene di-isocyanate | 2 parts by weight |
| methyl-ethyl-ketone | 6 parts by weight |

A composition having the above weight ratio was dispersed at room temperature for ten minutes by means of an ultrasonic dispersing device and applied on a conductive support comprising a polyester film 80 microns thick and laminated aluminum thereon 10 microns thick by means of a rotary application device, which was rotated 800 revolutions per minute so that it might be 7 microns thick after it was dried. The thus formed photosensitive layer of the electrophotographic photoreceptor was heated for about two hours for drying and hardening in a dryer heated to 160° to 170° C.

The thus prepared electrophotographic photoreceptor was measured with respect to electrostatic characteristics by means of an electrostatic paper analyzer SP-428 manufactured by Kawaguchi Electric Co. Ltd. in the order of processes 1 to 4 in the following Table 1 with the result of electrostatic characteristics as shown by a to d in FIG. 1. The measurement by the use of the SP-428 was made under the condition that a voltage of 5 KV was applied to a corotoron corona discharging device for positive charging with a gap of 9 mm between the discharging wire and the sample surface. The imagewise and activation exposures were performed with an illumination intensity of 3 luxes on the sample surface by means of tungsten light of 2854° K.

Table 1

| Process | L = lux(es) Steps | | |
|---|---|---|---|
| 1 | Charging 10 sec (5KV) | | |
| | | Dark Decay 5 sec | |
| | | | Imagewise Exp. (Light of W,3L) |
| 2 | Activation Exp. (Light of W,3L) | | |
| | Charging 10 sec (5KV) | | |
| | | Dark Decay 5 sec | |
| | | | Imagewise Exp. (Light of W,3L) |
| 3 | Activation Exp. (Light of W,3L) | | |
| | Charging 10 sec (5KV) | | |
| | | Dark Decay 5 sec | |
| | | | Imagewise Exp. (Light of W,3L) |
| 4 | Activation Exp. (Light of W,3L) | | |
| | Charging 10 sec 5(KV) | | |
| | | | Imagewise Exp. |

Table 1-continued

| Process | L = lux(es) Steps |
|---|---|
| | (Light of W,3L) |

From FIG. 1 it will be understood that the charging characteristics b, c, d of the photoreceptor subjected to the activation exposure exhibit a higher sensitivity than the conventional characteristic a not subjected to the activation exposure. The comparison of saturated potentials shows that they are substantially 650 V with no remarkable difference recognized therebetween. The observation of light decay curves in FIG. 1 further reveals that the activation light exposure improves the light decay.

In the measurements using the above-mentioned electrostatic paper analyzer SP-428, it has been found that the activation light exposure helps the acceleration of the light decay in the electrophotographic photoreceptor. It has also been found in the following measurement, that the method of the present invention is quite suitable for an electrophotographic copying machine of the repeated transfer type.

A metallic drum of 30 cm in diameter was provided at its circumference with a fluorescent lamp of 10 watts for the activation exposure, a corotoron charging device for positive charging, a halogen lamp of 750 watts for the imagewise exposure, a powder developer, an electrostatic transfer device and a cleaning brush. The electrophotographic photoreceptor of a size B4 was mounted on the drum, which was rotated at a speed of 100 cm per minute for copying at every transfer. The copying was effected twenty times at every 10-lux increment of the imagewise exposure in the range of illumination intensity of 10 to 200 luxes on the sample surface obtained by moving the exposure device. The copying was then similarly performed twenty times without the activation exposure at every 10-lux increment. The comparison of the visible images with and without the activation exposure showed that, in the formation of a proper visible image, the quantity of light with the activation light exposure was about one-third as much as the quantity of light without it. Further, the copying was effected 500 times without any interruption with the proper imagewise exposure by means of the copying machine equipped with the activation exposure lamp, with the result of production of the visible image having excellent quality images. In this case, the electrophotographic photoreceptor was free from wear at least up to 5000 copies.

EXAMPLE 2

| | |
|---|---|
| α-type copper phthalocyanine pigment, Fastgen Blue GP (manufactured by Dainippon Ink Chemical Industrial Co. Ltd.) | 0.33 part by weight |
| Bylon 200 (saturated polyester resin manufactured by Toyo Boseki Co. Ltd.) | 2 parts by weight |
| methyl-ethyl keton | 8 parts by weight |

A composition having the above weight ratio was ultrasonically dispersed for 15 minutes at room temperature and then applied on a conductive support comprising a polyester film 80 microns thick and laminated aluminum 10 microns thick by means of the rotary application device, which was rotated 700 revolutions per minute so that it might be 7 microns thick after it was dried. The thus prepared photosensitive layer was heated and dried in a heating drier at a temperature of 80° C. for about 10 minutes to prepare an electrophotographic photoreceptor. The photoreceptor was measured with respect to the electrostatic characteristics according to the processes 1 and 3 in the example 1 by means of the electrostatic paper analyzer SP-428 in order to compare each curve of the charging, dark decay and light decay. The result showed that, in both the processes, the saturated charging potential amounted to 450 V and the rate of dark decay (percentage of dark-decayed potential relative to charging potential) was 20%. The half-decay exposure (exposure required to attenuate the potential up to its half-value) was 16 lux-seconds in the process 1, whereas it was 8 lux-seconds in the process 3 with the sensitization about twice as great as that in the former.

The formation of the visible image was tried according to a method similar to that in the example 1 using this electrophotographic photoreceptor with the result that the proper visible image was obtained with a quantity of light with the activation exposure which was about half the quantity of light without it.

EXAMPLE 3

| | |
|---|---|
| β-type phthalocyanine pigment, Fastgen Blue GNT (manufactured by Dainippon Ink Chemical Industrial Co. Ltd.) | 0.47 part by weight |
| Panlite (polycarbonate resin manufactured by Teijin Kasei Co. Ltd.) | 1.4 parts by weight |
| methylene chloride | 14 parts by weight |

A composition having the above weight ratio was ultrasonically dispersed at room temperature for ten minutes and then applied on a 100-micron-thick plate of stainless steel by means of the rotary application device rotated about 800 revolutions per minute so that it might be 7 microns thick after drying. The thus prepared photosensitive layer was dried for ten minutes by a hot blast of 50° C. to form an electrophotographic photoreceptor. This photoreceptor was measured as to its electrostatic characteristics according to the processes 1 and 3 similarly as in the example 2 to compare each curve of the charging, dark decay and light decay with the result that, in both the processes, the saturated charging potential amounted to 530 V and the rate of dark decay was 22%. The half-decay exposure was 18 lux-seconds in the process 1, whereas it was 9 lux-seconds in the process 3 with sensitization about twice that of the process 1.

The electrophotographic photoreceptor was further used to form the visible image according to a method similar to that of the example 1, with the result that the proper visible image was obtained with a quantity of light with activation exposure about half the quantity of light without it.

EXAMPLE 4

| | |
|---|---|
| zinc oxide 0.5 micron in averaged granularity prepared by the French method | 4 parts by weight |
| Dianal 297 (acrylic resin manufactured by Mitsubishi | |

-continued

| | |
|---|---|
| Reiyon Co. Ltd.) | 1 part by weight |
| Rose Bengal | 0.012 part by weight |
| methyl alcohol | 0.1 part by weight |
| toluene | 5 parts by weight |

A composition having the above weight ratio was ultrasonically dispersed for five minutes at room temperature to prepare a photosensitive solution, which was applied by means of a wire bar on an underlayer of casein 2 microns thick supported by the conductive support of example 1 so that it might be 9 microns after drying. The solution was heated for drying at a temperature of 85° C. for ten minutes to prepare an electrophotographic photoreceptor for comparison. Another electrophotographic sample photoreceptor was prepared similarly to the photoreceptor for comparison with the exception of use of zinc oxide 0.2 micron in average granularity prepared by the French method.

The photoreceptor for comparison and the sample photoreceptor were measured by the electrostatic paper analyzer SP-428 with respect to their electrostatic characteristics according to processes 5 and 6 in the following Table 2. The condition was such that a voltage of 5.8 KV was applied to the corotorn charging device for negative charging with a gap of 9 mm between the discharging wire and the sample surface, and the activation and imagewise exposures were all effected by means of a tungsten lamp of 2854° K. with an illumination intensity of 5 luxes on the sample surface.

Table 2

| Process | L = lux(es) Steps | | |
|---|---|---|---|
| 5 | Charging 5 sec (5.8KV) | | |
| | | Dark Decay 5 sec | |
| | | | Imagewise Exp. (Light of W,5L) |
| 6 | Activation Exp. 5 sec (Light of W,5L) | | |
| | Charging 5 sec (5.8KV) | | |
| | | Dark Decay 5 sec | |
| | | | Imagewise Exp. (Light of W,5L) |

The measurements showed that, for the sample photoreceptor, the saturated charging potential was 550 V and the rate of dark decay was 18% in both the processes 5, 6, and the half-decay exposure was 18.5 lux-seconds in the process 5 and 9.1 lux-seconds in the process 6 with the apparent sensitization achieved in the latter process.

In the photoreceptor for comparison, on the other hand, the saturated charging potential was 540 V, the rate of dark decay 23% and the half-decay exposure 10 lux-seconds in process 5, while, in process 6, the saturated charging potential was 500 V, the rate of dark decay 30% and the half-decay exposure 8.5 lux-seconds. This shows the greater rate of dark decay and the absence of a remarkable effect due to the activation light exposure in process 6.

The sample photoreceptor and the photoreceptor for comparison were respectively mounted on a drum type copying machine equipped with a fluorescent lamp of 10 watts for the activation light exposure in example 1 for 500 successive copies. The quantity of light required for the proper exposure for successive copies was substantially the same for the sample photoreceptor as that for comparison the photoreceptor. In the sample photoreceptor, however, a visible image with high density was produced without any change during the formation step, while the image density was disadvantageously gradually reduced in the comparison photoreceptor as the copying operation continued.

In the copying without the fluorescent lamp of 10 watts, the sample photoreceptor required twice the quantity of exposure to form the proper image in comparison with the copying with the fluorescent lamp.

EXAMPLE 5

A photosensitive solution similar to that of the example 1 was applied on plates of stainless steel 100 microns thick similarly as in the example 1 to prepare 12 electrophotographic photoreceptor plates, which were measured as to 12 kinds of electrostatic characteristics by means of the electrostatic paper analyzer SP-428 of example 1 according to the different 12 conditions in the following Table 3.

A tungsten light of 2854° K. was used to derive therefrom three kinds of single light of 480, 580, 800 millimicrons in combination with the interference filters and various colored filters in order to effect the activation and imagewise exposures. The light intensities of the single light were respectively adjusted to be $0.17\times10^2$, $0.12\times10^2$ and $0.16\times10^2$ milliwatts/m$^2$. The charging was so performed that a voltage of 5.0 KV was applied to the corotoron discharging device for positive charging with a gap of 9 mm between the discharging wire and the sample surface.

The measurement was made according to the conventional process 1 and process 3 of this invention in example 1.

Table 3

| Group | Process No. | Measuring Conditions No. | Imagewize Exp. (mμ) | Activation Exp. (mμ) | Results X (seconds) | Results Y (ergs/cm$^2$) |
|---|---|---|---|---|---|---|
| | 1 | 1 | 480 | | | |
| | | 2 | 480 | 480 | | |
| 1 | 3 | 3 | 480 | 580 | 4.6 | 77 |
| | | 4 | 480 | 800 | 2.7 | 46 |
| | 1 | 5 | 580 | | 3.4 | 41 |
| | | 6 | 580 | 480 | 3 | 36 |
| 2 | 3 | 7 | 580 | 580 | 2.5 | 30 |
| | | 8 | 580 | 800 | 1.4 | 17 |
| | 1 | 9 | 800 | | 2.2 | 36 |
| | | 10 | 800 | 480 | 1.9 | 31 |
| 3 | 3 | 11 | 800 | 580 | 1.5 | 24 |
| | | 12 | 800 | 800 | 1.2 | 20 |

X = Half-decay period
Y = Quantity of light for half-decay period

Figure 4:
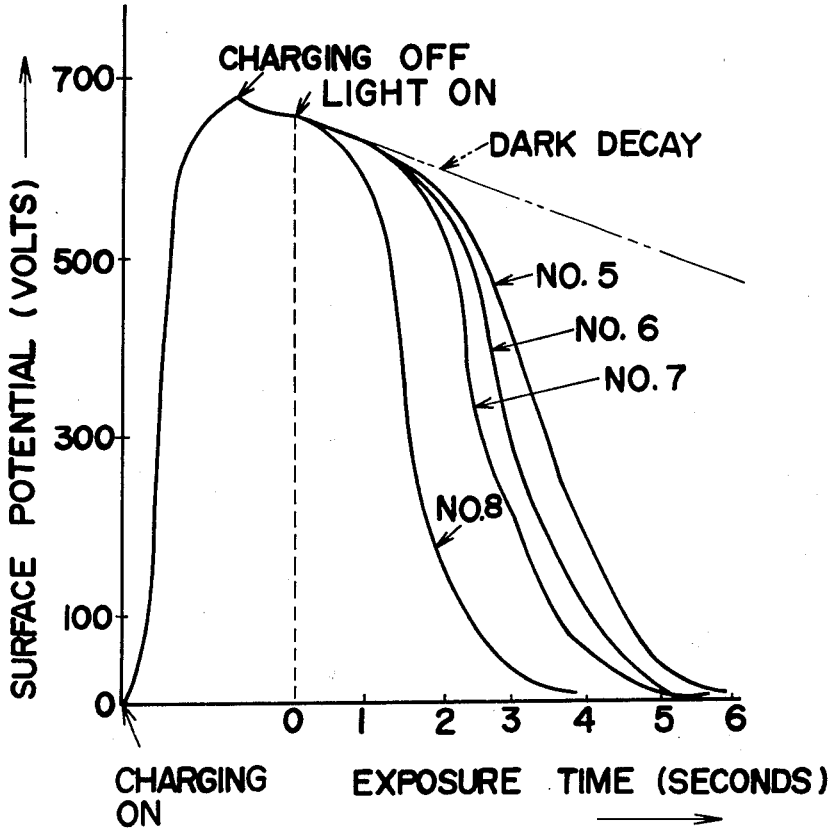
FIG. 4 is a graph showing electrostatic characteristics of example 5 in which an imagewise exposure is effected by the use of light having a single wavelength of 580 millimicrons.
Figure 5:
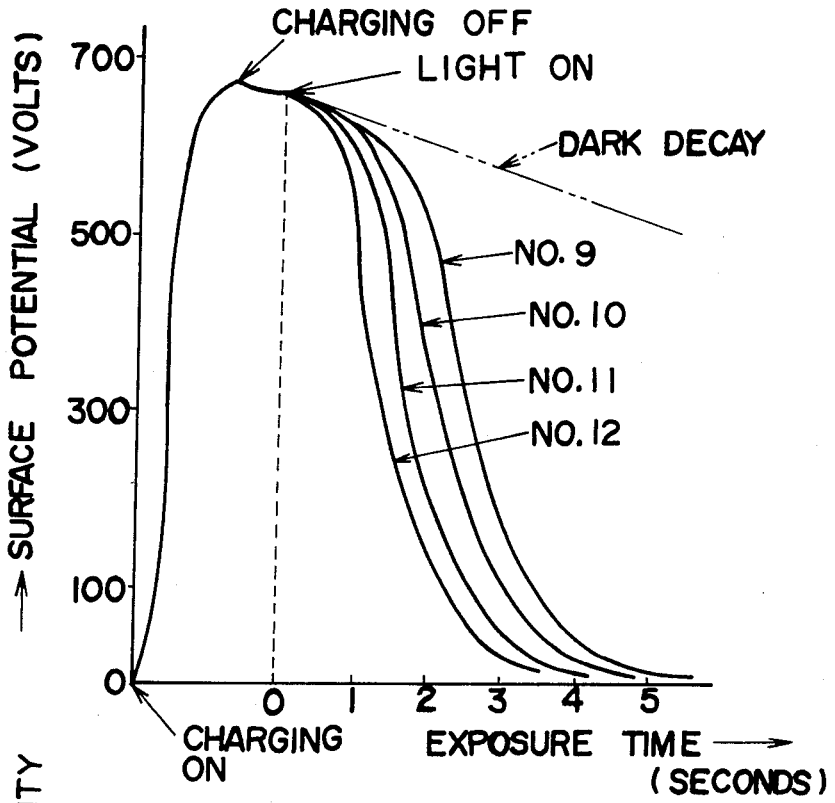
FIG. 5 is a graph showing electrostatic characteristics of example 5 in which an imagewise exposure is effected by the use of light having a single wavelength of 800 millimicrons.

The electrostatic characteristics obtained by the measurement are shown in FIG. 3 with respect to the first group, in FIG. 4 with respect to the second group, and in FIG. 5 with respect to the third group, respectively. The half-decay period and the quantity of light therefor are shown in Table 3 in terms of seconds and ergs/cm$^2$, respectively.

Figure 6:
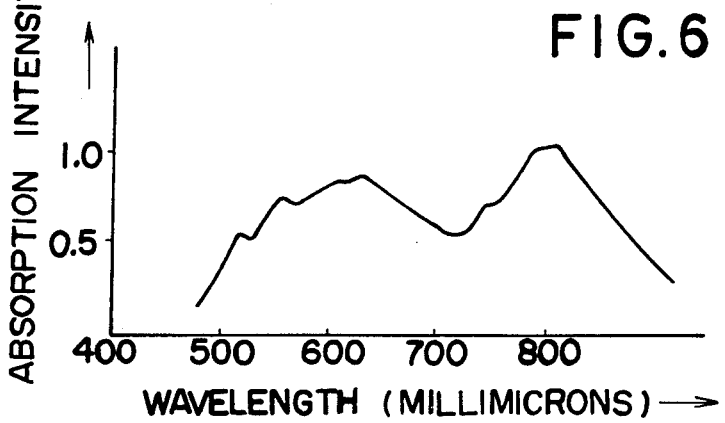
FIG. 6 is an absorption spectrum of an electrophotographic photoreceptor of $\epsilon$-type copper phthalocyanine by means of a xenon lamp.

The electrophotographic photoreceptor of the present invention containing the ε-type copper phthalocyanine pigment was measured with respect to an absorpotion spectrum, which was shown in FIG. 6.

From data in Table 3 and the absorption spectrum in FIG. 6 it will be apparent that the activation light exposure prior to the imagewise exposure causes light decay to take place in the electrophotographic photoreceptor a few times more rapidly than light decay without it, and that the nearer the spectrum of light for the imagewise exposure is to a strong absorption wavelength region in the electrophotographic photoreceptor, the more rapidly the light decay occurs, and the nearer the spectrum of activation light is to the strong absorption wavelength region therein, the greater sensitization effect is obtained. Thus, it will be understood that light decay takes place most rapidly when the spectrum of light for both the imagewise and activation exposures is in the region of the strong absorption wavelength (for example, 800 millimicrons) of the electrophotographic photoreceptor. The data in Table 3 further show that the electrophotographic photoreceptor is suitable for use in a He-Ne laser or semiconductor laser from the viewpoint of spectral sensitivity.

Thus an electrophotographic copying machine of the repeated transfer type which utilizes the electrophotographic photoreceptor of a binder type of less than 0.3 micron (of the type in which the fine photoconductive powder is dispersed in the resin), particularly a photoreceptor containing copper phthalocyanine has the advantages of being free from wear upon repeated transfer and capable of high-speed reproduction, if a residual charge cleaning lamp is used as a light source for activation exposure, which selectively includes a spectrum at which copper phthalocyanine exhibits a strong absorption, or if light is used which includes the spectrum in the strong absorption wavelength region or a spectrum useful for cleaning the residual charges.

EXAMPLE 6

| | |
|---|---|
| α-type copper phthalocyanine pigment, Fastgen Blue FSN (manufactured by Dainippon Ink Chemical Industrial Co. Ltd.) | 1 part by wight |
| phenol hormaldehye resin including a t-buthyl radical in para-position (compound example 1) | parts by weight |
| methyl-ethyl-keton | 40 parts by weight |

A composition having the above weight ratio was dispersed at room temperature for 5 minutes by means of the ultrasonic dispersing device, and then applied on a conductive support comprising a polyester film 80 microns thick and laminated aluminum thereon 10 microns thick by means of the rotary application device, which was rotated 300 revolutions per minute so that it might be 7 microns after drying. The thus prepared photoreceptor was heated for about one hour to dry in a drier heated to a temperature of 80° C. to prepare an electrophotographic sample photoreceptor.

The thus prepared sample photoreceptor was measured with respect to its charging characteristics by means of the electrostatic paper analyzer SP-428 under the condition that the corona discharge of +6.0 KV was performed in a dark place for positive charging for 10 seconds and the tungsten light of 2854° K. was radiated on the sample surface with an illumination intensity of 35 luxes.

Figure 7A:
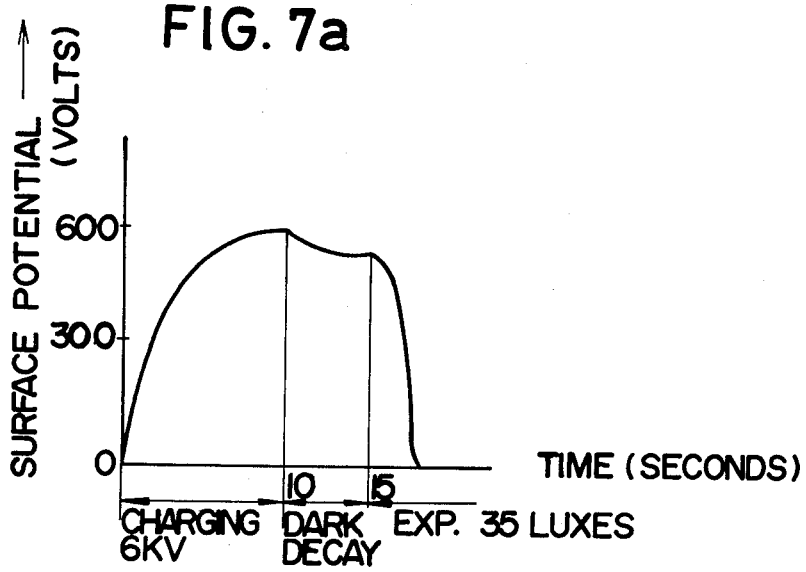
FIG. 7*a* is a graph showing the electrostatic characteristic of an electrophotographic sample photoreceptor in example 6.
Figure 7B:
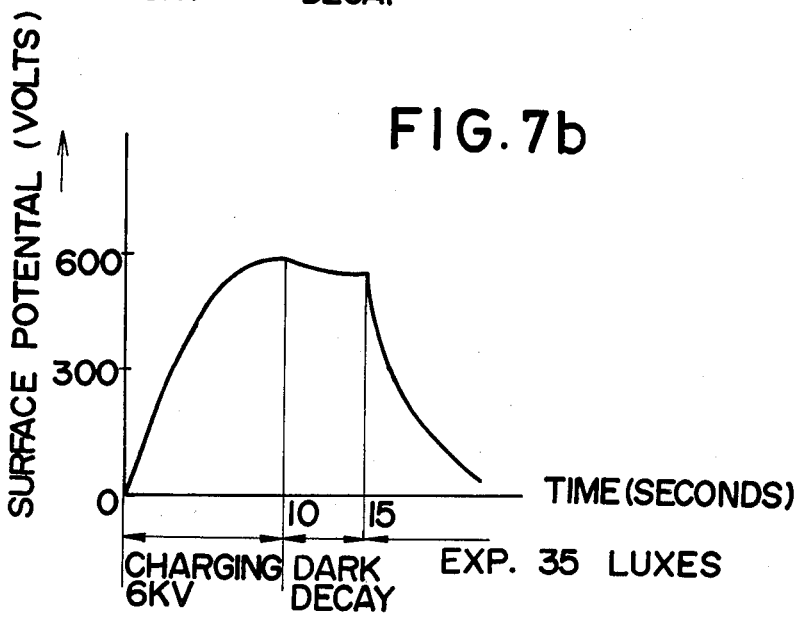
FIG. 7*b* is a graph showing the electrostatic characteristic of an electrophotographic sample photoreceptor for comparison as described in example 6.

The result was that the quantity of exposure required to attenuate the surface potential up to its half-value (the half-decay exposure) was 12 lux-seconds with an S-shaped light decay curve as shown in FIG. 7a. Another electrophotographic photoreceptor was prepared which, instead of the above binder (compound example 1), contains a phenol formaldehyde resin (compound example 1 for comparison to be described later) having 65% of the methyl radicals in the para-position and about 35% of the methyl radicals in the meta-position and other substances which are the same as above. The similar measurements showed that the half-decay exposure was 40 lux-seconds and the light decay curve was L-shaped as shown in FIG. 7b.

The sample photoreceptor and the photoreceptor for comparison were then measured as to the electrostatic characteristics according to process 5 without the activation exposure and process 6 with it as in the example 4 with exception that a voltage of 6 V was applied thereto for positive charging with the result that, for the sample photoreceptor, the saturated charging potential was 600 V and the rate of dark decay 20% in both processes 5, 6 with the half-decay exposure being 12 lux-seconds in process 5 and 6 lux-seconds in process 6 with obvious sensitization obtained. For the photoreceptor for comparison, on the other hand, the half-decay exposure was 40 lux-seconds in process 5 and 35 lux-seconds in process 6 with less sensitization than the sample photoreceptor.

EXAMPLE 7

Various phenol resins and phthalocyanine pigments shown by the above compounds were used to prepare 15 kinds of electrophotographic sample photoreceptors according to the method in example 6.

Separately, resins of the following compounds for comparison were further used to prepare electrophotographic photoreceptors for comparison similarly according to the method in example 6 for 16 kinds of comparison measurements in combination with the sample photoreceptors. These sample photoreceptors and photoreceptors for comparison were measured with respect to their electrostatic characteristics according to a method similar to that of example 1 with the result of data as shown in Table 4.

Table 4

| No. | Resin | Phthalocyanine Pigments | Charging Polarity | Half-decay Exp. (L-Sec) | Electro-static Charac-teristic |
|---|---|---|---|---|---|
| 1 | X No. 1 | ε-type copper phthalocyanine | + | 8.8 | S-shaped |
| | Y No. 1 | same as above | + | 20 | L-shaped |
| 2 | X No. 1 | β-type-copper phthalocyanine | + | 21 | S-shaped |
| | Y No. 1 | same as above | + | 70 | L-shaped |
| 3 | X No. 6 | ε-type copper phthalocyanine | + | 8.6 | S-shaped |
| | Y No. 1 | same as above | + | 20 | L-shaped |
| 4 | X No. 2 | same as above | + | 9.0 | S-shaped |
| | Y No. 2 | same as above | + | 22 | L-shaped |
| 5 | X No. 3 | α-type copper phthalocyanine | + | 12 | S-shaped |
| | Y No. 4 | same as above | + | 40 | L-shaped |
| 6 | X No. 4 | same as above | + | 13 | S-shaped |
| | Y No. 4 | same as above | + | 41 | L-shaped |
| 7 | X No. 5 | same as above | + | 11 | S-shaped |
| | Y No. 5 | same as above | + | 38 | L-shaped |
| 8 | X No. 7 | same as above | + | 15 | S-shaped |
| | Y No. 6 | same as above | + | 39 | L-shaped |
| 9 | X No. 8 | same as above | + | 14 | S-shaped |
| | Y No. 2 | same as above | + | 40 | L-shaped |
| 10 | X No. 9 | same as above | + | 12 | S-shaped |
| | Y No. 2 | same as above | + | 40 | L-shaped |
| 11 | X No. 10 | same as above | + | 11 | S-shaped |
| | Y No. 2 | same as above | + | 40 | L-shaped |
| 12 | X No. 11 | same as above | + | 15 | S-shaped |

Table 4-continued

| No. | Resin | Phthalocyanine Pigments | Charging Polarity | Half-decay Exp. (L-Sec) | Electro-static Charac-teristic |
|---|---|---|---|---|---|
| | Y No. 2 | same as above | + | 40 | L-shaped |
| 13 | X No. 12 | same as above | + | 11 | S-shaped |
| | Y No. 2 | same as above | + | 40 | S-shaped |
| 14 | X No. 13 | same as above | + | 14 | S-shaped |
| | Y No. 2 | same as above | + | 40 | L-shaped |
| 15 | X No. 14 | same as above | + | 10 | S-shaped |
| | Y No. 2 | same as above | + | 40 | L-shaped |
| 16 | X No. 15 | ϵ-type copper | + | 15 | S-shaped |
| | Y No. 1 | phthalocyanine | + | 20 | L-shaped |

X = Compound Example
Y = Compound Example for Comparison
Compound examples for comparison (1)

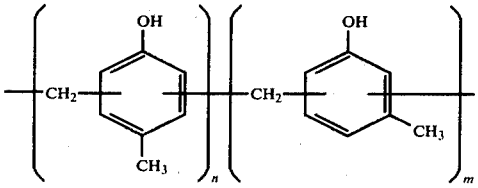

n ≈ 20 m ≈ 10

(2)

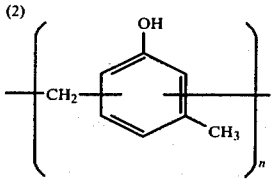

n ≈ 20

(3)

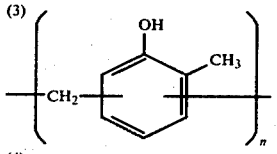

n ≈ 70

(4)

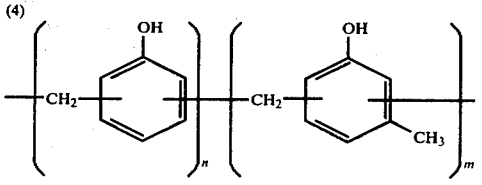

n ≈ 5 m ≈ 15

(5)

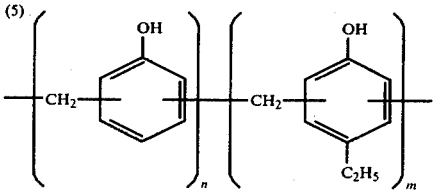

n ≈ 15 m ≈ 5

(6)

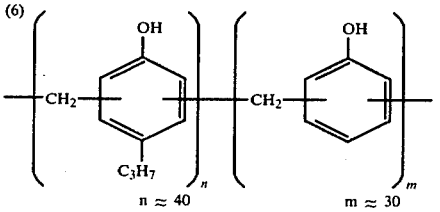

n ≈ 40 m ≈ 30

It is to be noted that, in Table 4, the α-type phthalocyanine is Fastgen Blue FNS manufactured by Dainippon Ink Chemical Industrial Co. Ltd.; β-type is Fastgen Blue FGF manufactured by the same; and the ϵ-type is Lionol Blue ER (manufactured by Toyo Ink Co. Ltd.)

Table 4 reveals that the sample photoreceptor of the present invention comprising the phthalocyanine pigment and binder resin of the compound examples generally exhibits an S-shaped light decay characteristic upon positive charging with to rapid sensitivity than the photoreceptor for comparison comprising the binder resin of the compounds for comparison, which generally exhibits the L-shaped light decay characteristic.

Further, the sample photoreceptor and the photoreceptor for comparison shown in Table 4 were measured with respect to their characteristics according to process 5 without the activation exposure and process 6 with it similarly as in the example 6 with result that the sample photoreceptor exhibiting an S-shaped light decay characteristic had a remarkable effect due to the activation light exposure with more than about twice as much sensitization as that in the photoreceptor for comparison.

The photoreceptor for comparison exhibiting an L-shaped light decay characteristic, on the other hand, indeed has a recognizable sensitization effect, but less than the sample photoreceptor. This would be due to the fact that the sample photoreceptor exhibiting an S-shaped light decay characteristic has many traps for capturing generated carriers in the electrophotographic photoreceptor, and the traps are effectively filled upon exposure by activation light.

EXAMPLE 8

For measurement of the photosensitivity (half-decay exposure) according to a method similar to that in the example 6, an electrophotographic photoreceptor was prepared which comprises a binder resin of a mixture of the abovementioned compound example 1 and compound example 1 for comparison, and an ϵ-type copper phthalocyanine pigment dispersed therein.

Figure 8:
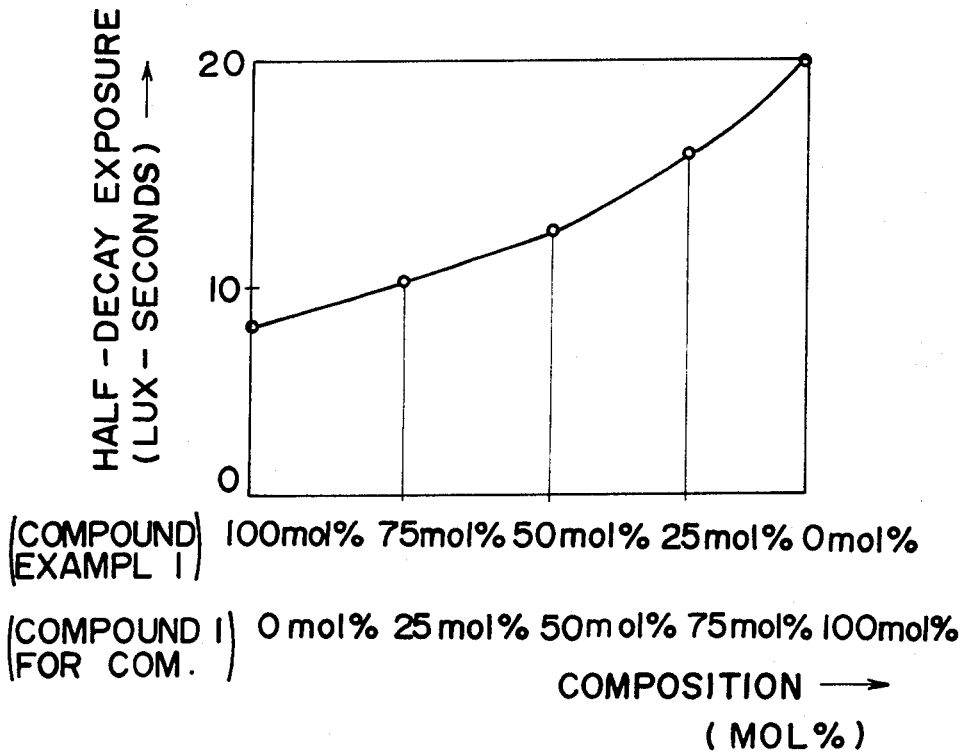
FIG. 8 is a graph showing the relation the of the ratio of a mixture of a binder resin of the invention and a comparison resin to the half-decay exposure in an electrophotographic photoreceptor of $\epsilon$-type copper phthalocyanine as described in example 8.

As shown in FIG. 8, the photosensitivity depends upon the ratio of the mixture of the two kinds of resins, and increases as the photoreceptor contains more compound example 1. It will be recognized that the addition of the resin having a substituted radical of more than four carbon atoms has an effect to the increase in photosensitivity.

EXAMPLE 9

Figure 9:
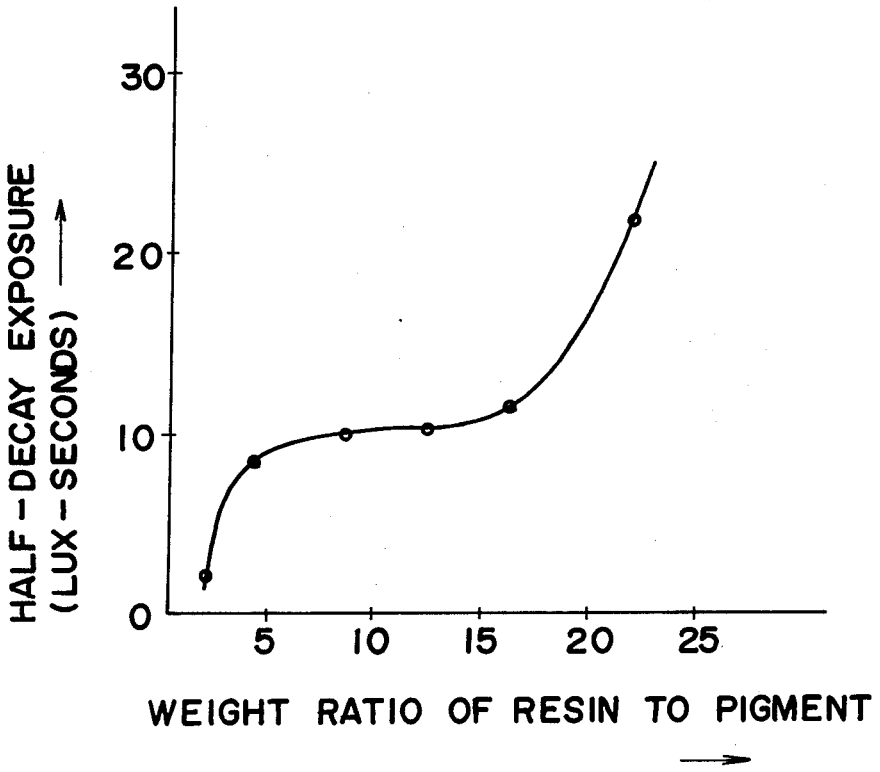
FIG. 9 is a graph showing the relation between the ratio of a binder resin to phthalocyanine pigment and the half-decay exposure in an electrophotographic photoreceptor of $\epsilon$-type copper phthalocyanine described in example 9.

An electrophotographic photoreceptor was prepared which comprises a binder resin of compound example 1 and ϵ-type copper phthalocyanine with the mixture ratio varied. The half-decay exposure is shown in FIG. 9, which reveals that the photosensitivity is kept substantially constant in the range of 1:3 to 1:20 of weight ratio of the resin to ϵ-type copper phthalocyanine. An increase in amount of resin above this range causes a rapid reduction of the photosensitivity, while the decrease below the range results in a remarkable increase in photosensitivity, but another experiment shows that it also causes an increase in dark decay because the amount of resin is to small with the result of no practicability. It is thus understood that the ratio of the resin to ϵ-type copper phthalocyanine is prefarably 1:3 to 1:20 by weight.

EXAMPLE 10

ϵ-type copper phthalocyanine pigment, Lionol Blue ER (manufactured by Toyo Ink Co. Ltd.) 1 part by weight phenol formaldehyde having a t-butyl radical in -continued

| | |
|---|---|
| para-position (compound example 1) | 6 parts by weight |
| methyl-ethyl-ketone | 40 parts by weight |

A composition having the above weight ratio was ultrasonically dispersed at room temperature for five minutes, and then applied on a rough-surfaced and anode-oxidized plate of aluminum by means of the rotary application device, which was rotated 500 revolutions per minute so that it might be 4 microns after drying. The thus prepared photoreceptor was heated to dry for about three hours in a drier heated to a temperature of 60° C. to prepare a sample photoreceptor.

The sample photoreceptor was subjected to a discharge of +6.0 KV in a dark place so that its surface potential might be about 300 V, and then simultaneously irradiated with activation light of an incandescent lamp of tungsten of 10 luxes. The photoreceptor was then imagewise exposed (20 lux-seconds) and developed by a magnetic brush method. As a result, a sharp toner image without any fog was formed on the photoreceptor. After the toner image was heated for fixing, the photoconductive layer was removed therefrom by an alkaline solution containing methyl-ethyl-ketone in order to prepare a lithographic plate.

Separately, another sample photoreceptor was prepared similarly with the exception of the absence of exposure by activation light to form a toner image, which was, however, much fogged. The formation of the lithographic plate thus resulted in blurred image with a dirty surface. Thus, it was found that a method of this invention was useful for the formation of the lithographic plate.

What is claimed is:

1. An electrophotographic photoreceptor consisting essentially of a resin and a photoconductive phthalocyanine pigment dispersed in said resin in a ratio by weight of said pigment to said resin of 1:3 to 1:20, adapted for use in forming an electrostatic image in an electrophotography, wherein said resin comprises a phenol resin having a polymerization degree of from 2 to 10,000 consisting essentially of a substance having the following formula

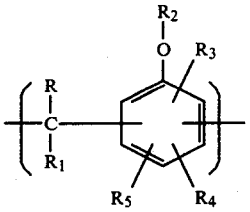

where R and $R_1$ are a hydrogen atom or methyl radical; $R_2$ a hydrogen atom or epoxy radical; and $R_3$, $R_4$ and $R_5$ are a hydrogen atom, halogen atom or alkyl or alkoxy radical having 1 to 20 carbon atoms, at least one of said $R_3$, $R_4$ and $R_5$ being an alkyl or alkoxy radical having 4 to 20 carbon atoms.

2. An electrophotographic photoreceptor according to claim 1 wherein the degree of polymerization of said resin is from 2 to 100.

3. An electrophotographic photoreceptor according to claim 1, wherein said photoconductive phthalocyanine pigment contains metalfree phthalocyanine, copper phthalocyanine, cobalt phthalocyanine, lead phthalocyanine or zinc phthalocyanine.

4. An electrophotographic photoreceptor according to claim 3, wherein said metalfree phthalocyanine and copper phthalocyanine are of an $\alpha$, $\beta$, $\gamma$, $\chi$, $\pi$ or $\epsilon$-type.

* * * * *